US005713313A

United States Patent [19]

Berry

[11] Patent Number: 5,713,313

[45] Date of Patent: Feb. 3, 1998

[54] COMBUSTION POWERED TOOL WITH DUAL FANS

[75] Inventor: Robert J. Berry, Gurnee, Ill.

[73] Assignee: Illinois Tool Works Inc., Glenview, Ill.

[21] Appl. No.: 798,429

[22] Filed: Feb. 7, 1997

[51] Int. Cl.[6] ..... F02B 71/04

[52] U.S. Cl. ..... 123/46 SC; 227/10

[58] Field of Search ..... 123/46 SC; 227/10, 227/9

[56] References Cited

U.S. PATENT DOCUMENTS

| | | | |
|---|---|---|---|
| Re. 32,452 | 7/1987 | Nikolich | 123/46 SC |
| 4,403,722 | 9/1983 | Nikolich | 227/8 |
| 4,483,280 | 11/1984 | Nikolich | 123/46 SC |
| 4,483,473 | 11/1984 | Wagdy | 227/8 |
| 4,483,474 | 11/1984 | Nikolich | 227/8 |
| 4,522,162 | 6/1985 | Nikolich | 123/46 SC |
| 5,197,646 | 3/1993 | Nikolich | 123/46 SC |
| 5,263,439 | 11/1993 | Doherty et al. | 123/46 SC |

*Primary Examiner*—David A. Okonsky

*Attorney, Agent, or Firm*—Mark W. Croll; Thomas W. Buckman; John P. O'Brien

[57] ABSTRACT

A combustion powered tool having a self-contained internal combustion power source constructed and arranged for creating a combustion for driving a driver blade to impact a fastener and drive it into a workpiece includes a housing having a main chamber enclosing the power source, a combustion chamber defined within the main chamber, an air flow enhancing device disposed in the combustion chamber for enhancing the flow of air therein, and a supplemental air flow enhancing device disposed externally of the combustion chamber and within the housing for forcing air past the combustion chamber as a cooling mechanism.

18 Claims, 3 Drawing Sheets

32
30
96
83
10
92
94
12
34
38
42
44
90
40
48
16
46
80
76
50
76
74
90
62
78
66
60
52
60
20
14
58
68
98
18
56
72
88
70
28
54
22
26

COMBUSTION POWERED TOOL WITH DUAL FANS

BACKGROUND OF THE INVENTION

The present invention relates generally to improvements in portable combustion powered fastener driving tools, and specifically to improvements relating to the introduction of air into the combustion chamber for more rapid cycling of the tool between firings.

Portable combustion powered, or so-called IMPULSE® brand tools for use in driving fasteners into workpieces are described in commonly assigned patents to Nikolich U.S. Pat. Re. No. 32,452, and U.S. Pat. Nos. 4,522,162, 4,483,473, 4,483,474, 4,403,722, and 5,263,439, all of which are incorporated by reference herein. Similar combustion powered nail and staple driving tools are available commercially from ITW-Paslode of Lincolnshire, Illinois under the IMPULSE® brand.

Such tools incorporate a generally pistol-shaped tool housing enclosing a small internal combustion engine. The engine is powered by a canister of pressurized fuel gas, also called a fuel cell and includes a reciprocating piston with an elongate, rigid driver blade disposed within a cylinder body. A powerful, battery-powered electronic power distribution unit produces the spark for ignition. A fan located in the combustion chamber provides for both an efficient combustion within the chamber, facilitates scavenging, including the exhaust of combustion by-products, and aids in cooling the tool.

A valve sleeve is axially reciprocable about the cylinder and, through a linkage, moves to close the combustion chamber when a work contact element at the end of the linkage is pressed against a workpiece. The tool is then in what is referred to as the closed position. This pressing action also triggers a fuel metering valve to introduce a specified volume of fuel into the closed combustion chamber.

Upon the pulling of a trigger switch, which causes the ignition of a charge of gas in the combustion chamber of the engine, the piston and driver blade are shot downward to impact a positioned fastener and drive it into the workpiece. The piston then returns to its original, or "ready" position through differential gas pressures within the cylinder, at least partially caused by the cooling and collapsing of the gas above the piston in the enclosed combustion chamber. Once the user lifts the tool from the substrate, and for certain tools upon the release of the trigger, the valve sleeve moves downward to open the combustion chamber for the scavenging of the spent combustion gas and further cooling the tool. The tool remains in the open position until it is pressed against a substrate to cause the valve sleeve to close the combustion chamber in anticipation of firing. Fasteners are fed magazine-style into the nosepiece, where they are held in a properly positioned orientation for receiving the impact of the driver blade.

There has been a demand on the part of users of conventional combustion tools for a more rapid cycle time, or the time between firings of the tool. Shorter cycle times mean that the operator can perform more work with the tool during a set period of time. However, conventional combustion powered tools have a cycle time which is governed by the rate of return of the piston and driver blade to the firing position. As described above, the rate of such return is governed by differential gas pressures which are influenced at least in part, by the rate combusted gases can be cooled. To date, this rate of return has been considered to be fairly constant, but it is thought it could be increased through enhanced cooling.

Accordingly, it is an object of the present invention to provide an improved combustion powered tool which has a faster cycle time between firings than conventional combustion tools.

Another object of the present invention is to provide an improved combustion powered tool which features enhanced cooling of the combustion chamber.

Another object of the present invention is to provide improved scavenging of the combustion chamber.

A further object of the present invention is to provide an improved combustion powered tool wherein the electric fan located within the combustion chamber is provided with a supplemental fan located externally of the combustion chamber.

An additional object of the present invention is to provide an improved combustion powered tool featuring the elimination of the electric fan in the combustion chamber and replacing same with an externally mounted fan and a fuel injection device.

BRIEF SUMMARY OF THE INVENTION

The above-listed objects are met or exceeded by the present improved combustion powered fastener tool, which features a fan in the combustion chamber for mixing the combustion gases and facilitating their expulsion post combustion, and a second, supplemental fan located externally of the combustion chamber for cooling the exterior of the combustion chamber, and thus facilitating the return of the piston from the opposite end of the chamber. The second fan also aids in the scavenging of the post combustion gas in the combustion chamber. In an alternate embodiment, the main fan in the combustion chamber is replaced by a fuel injector and the only fan is the supplemental fan.

More specifically, the present invention provides a combustion powered tool having a self-contained internal combustion power source constructed and arranged for creating a combustion for driving a driver blade to impact a fastener and drive it into a workpiece. The tool includes a housing having a main chamber enclosing the power source, a combustion chamber defined within the main chamber, and an air flow enhancing device disposed in the combustion chamber for enhancing the flow of air therein. In addition, a supplemental air flow enhancing device is disposed externally of the combustion chamber and within the housing for forcing air past the combustion chamber as a cooling mechanism.

According to another feature of the present invention, a combustion powered fastener driving tool is provided with a self-contained internal combustion power source and constructed and arranged for creating a combustion for driving a driver blade to impact a fastener and drive it into a workpiece. The tool includes a housing having a main chamber enclosing the power source, a combustion chamber being defined within the main chamber and a cylinder within the main chamber enclosing a piston to drive the driver blade toward the fastener as the piston is driven toward a terminal end of the cylinder. A supplemental air flow enhancing device is located externally of the combustion chamber and within the housing for drawing ambient air into the housing and past at least one of the combustion chamber and the cylinder during operation.

DETAILED DESCRIPTION OF THE INVENTION

Figure 1:
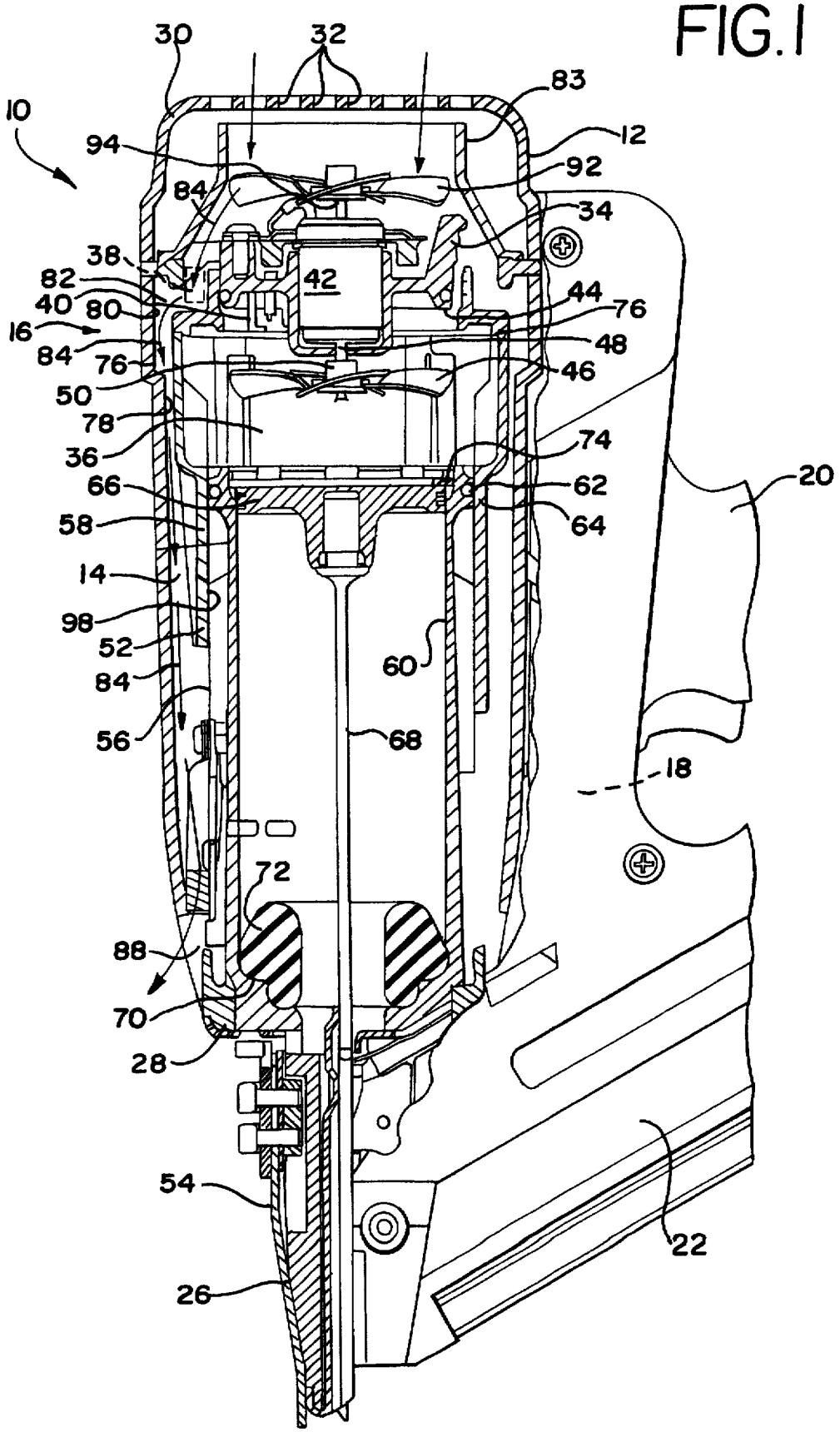
FIG. 1 is a fragmentary side view of a combustion powered fastener tool in accordance with the present invention shown in the closed position, partially cut away for purposes of clarity.
Figure 2:
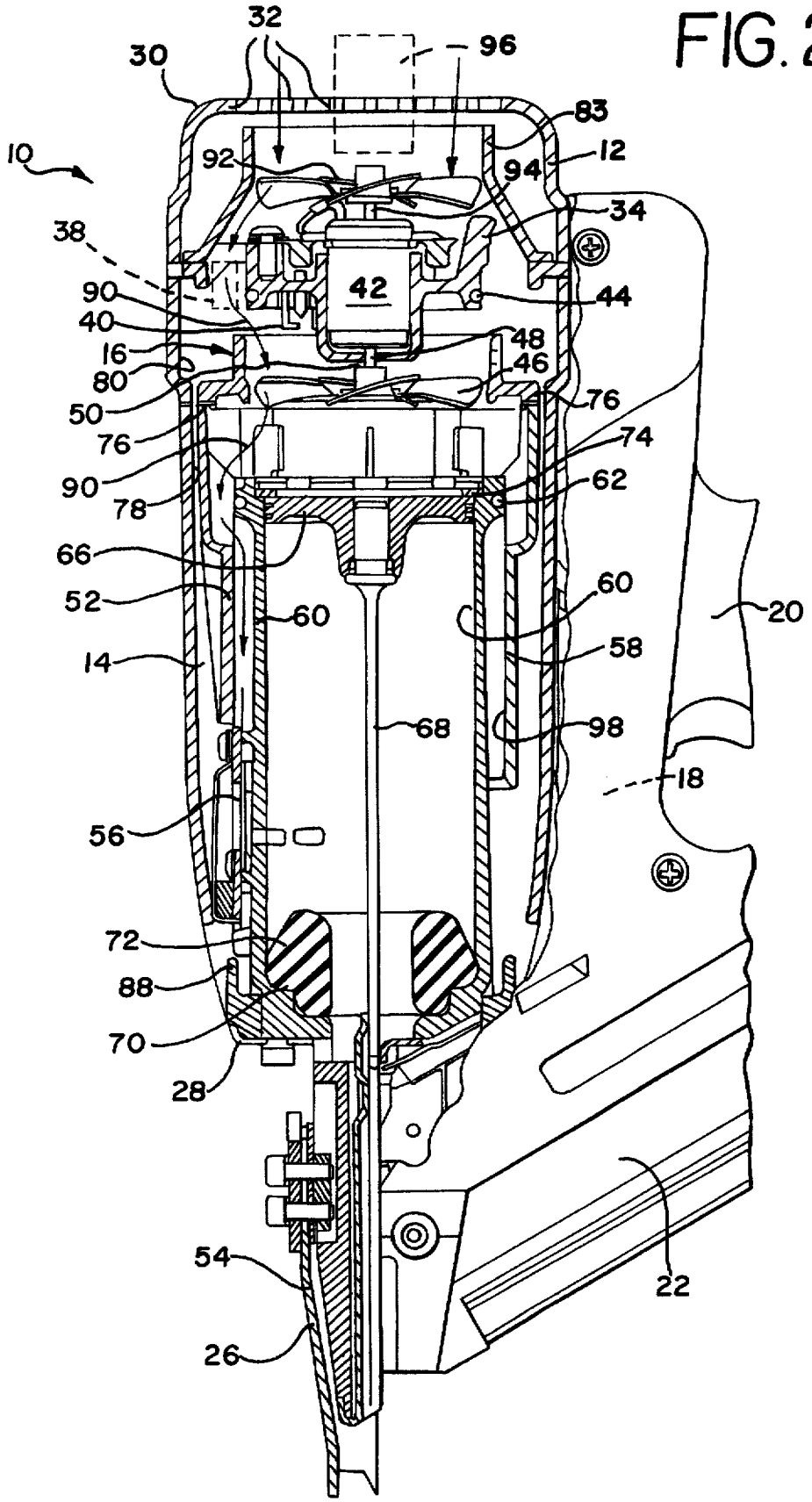
FIG. 2 is a fragmentary side view of a combustion powered fastener tool in accordance with the present invention shown in the open position, partially cut away for purposes of clarity.

Referring now to FIGS. 1 and 2, a combustion-powered tool of the type suitable for use with the present invention is generally designated 10. The tool 10 has a housing 12 including a main power source chamber 14 dimensioned to enclose a self-contained internal combustion power source 16, a fuel cell chamber 18 (best seen in FIG. 3 generally parallel with and adjacent the main chamber 14, and a handle portion 20 extending from one side of the fuel cell chamber and opposite the main chamber.

In addition, a fastener magazine 22 is positioned below the handle portion and extends to a nosepiece 26 depending from a first or lower end 28 of the main chamber 14. A battery (not shown) is provided for providing electrical power to the tool 10, and is releasably housed in a tubular compartment (not shown) located in the handle portion 20.

As used herein, "lower" and "upper" are used to refer to the tool 10 in its operational orientation as depicted in FIGS. 1 and 2; however it will be understood that this invention may be used in a variety of orientations depending on the application. Opposite the lower end 28 of the main chamber is a second or upper end 30, which is provided with a plurality of air intake vents 32.

In a preferred embodiment, an electro-magnetic, solenoid-type fuel metering valve 33 (best seen in FIG. 3) or an injector valve of the type described in commonly-assigned U.S. Pat. No. 5,263,439 is provided to introduce fuel into the combustion chamber as described below. A pressurized liquid hydrocarbon fuel, such as MAPP, and designated F, is contained within a fuel cell 35 (best seen in FIG. 3) and pressurized by a propellant as is known in the art. A fluid communication is established between the fuel cell 35 and the valve 33. In another embodiment, a mechanically operated valve may be used, such as that currently available in an IMPULSE® tool sold by ITW-Paslode.

Returning to the main chamber 14, a cylinder head 34 is disposed at the upper end 30 of the main chamber, and defines an upper end of a combustion chamber 36, also located at the upper end of the chamber, and provides a mounting point for a head switch 38 (shown in phantom), a spark plug 40, an electric fan motor 42, and a sealing O-ring 44.

A main or combustion chamber fan 46 is attached to an armature or power shaft 48 of the motor 42 at a first end 50 of the armature. Located within the combustion chamber 36 to axially rotate, the fan 46 thus enhances the combustion process by mixing the fuel and air, and also to facilitates cooling and scavenging. The fan motor 42 is controlled by the head switch 38, as disclosed in more detail in the prior patents incorporated by reference. The fan 46 serves as a main air flow enhancing device for enhancing the flow of air within the combustion chamber 36.

A generally cylindrical, reciprocating valve member or valve sleeve 52 is moved within the main chamber 14 by a workpiece-contacting element 54 on the nosepiece 26 using a linkage 56. Sidewalls of the combustion chamber 36 are defined by the valve member 52, the upper end of which sealingly engages the O-ring 44 to seal the upper end of the combustion chamber. A lower portion 58 of the valve member 52 circumscribes a generally cylindrical cylinder body 60. An upper end of the cylinder body 60 is provided with an exterior O-ring 62 which engages a corresponding portion 64 of the valve member 52 to seal a lower end of the combustion chamber 36.

Within the cylinder body 60 is reciprocally disposed a piston 66 to which is attached a rigid, elongate driver blade 68 used to drive fasteners (not shown), suitably positioned in the nosepiece 26, into a workpiece. In response, the piston 66 is driven toward a lower end of the cylinder 60. As the piston 66 approaches the lower end, the driver blade 68 will be guided into the nosepiece 26 and impact a fastener (not shown) held above a workpiece by the nosepiece. Impact of the driver blade 68 drives the fastener into a workpiece or substrate.

As a safety feature, and to regulate the use of fuel, the firing of the tool will not occur unless the nosepiece 26 is pressed against a workpiece. Such placement causes the linkage 56 to be pushed upward, which moves the valve member 52 to seal the combustion chamber 36. Details concerning sealing of the combustion chamber 36, and related mechanisms may be found in the previously mentioned Nikolich patents, which are incorporated by reference.

A lower end of the cylinder body 60 defines a seat 70 for a bumper 72 which defines the lower limit of travel of the piston 66. At the opposite end of the cylinder body 60, a piston stop retaining ring 74 is affixed to limit the upward travel of the piston 66.

Another feature of the upper end of the valve member 52 relates to a need to provide directed air flow to portions of the tool 10 to prevent overheating and enhance cooling. Although air is free to flow from the air intake vents 32 in conventional combustion tools to internal components such as the combustion chamber and the cylinder body, that flow is insufficient to satisfactorily cool the power source. Thus, in conventional combustion tools, during extended periods of operation, both the combustion chamber 36 and the cylinder body 60 become hot, to the extent that the heat in the exploded exhaust gas, which is generated to force the piston 66 down the cylinder, does not dissipate immediately to allow the gas to collapse and suck the piston up. This residual heat intake gas interferes with the creation of the vacuum which assists in bringing the piston 66 back to the top of the cylinder body 60 as seen in FIGS. 1 and 2.

Accordingly, the present tool 10 features an annular air dam 76 which projects radially from the valve member 52 to engage an inner surface 78 of the main housing 12 periodically during operation of the tool 10 (best seen in FIG. 2). In this regard, the inner surface 78 includes a recess 80 which defines an enlarged annular space 82 through which passes outside air dram through the air intake vents 32. In addition, a funnel 83 is secured to the housing 12 to assist in directing ambient air into the tool 10.

In the closed position of the tool 10 (FIG. 1), the valve member 52 is positioned relative to the annular space 82 so that the air dam 76 does not impede air flow past the valve member and the combustion chamber 36, the air flow being represented by the arrows 84. At the lower end of the cylinder body 60, the air exits to the outside through an outlet 88.

However, in the open position of the tool 10 (FIG. 2), which is achieved when the user lifts the tool from the substrate, the valve member 52 moves toward the lower end 28 of the tool 10, and the air dam 76 more closely engages the inner surface 78 of the housing 12. The exact tolerances between the edge of the air dam 76 and the inner surface 78 will vary with the application, however, the objective is that in the open position, a pressure drop is created such that the air dam will prevent the flow of air toward the lower end 28 past the outside of the valve member 52. Instead, the air may flow in the pattern indicated by the arrows 90, which passes through the combustion chamber 36 to enhance the scavenging and outside the cylinder body 60. As is the case with the closed position in FIG. 1, the air eventually reaches the outside and the outlet 88.

Although in conventional IMPULSE ® combustion tools, the main fan 46 runs for a designated period of time after combustion to facilitate scavenging of combustion gases, and provides some additional circulation of the air within the combustion chamber 36 and the cylinder body 60, there is still a tendency in such tools for these components to heat up during extended operation, even with the provision of the air dam 76.

Accordingly, an important feature of the present tool 10 is the provision of a supplemental air source for cooling the cylinder body 60 and the combustion chamber 36 during operation so that the exhaust gas will condense or collapse and dissipate more quickly. The ultimate advantage of cooled components is their assistance in the creation of a vacuum within both the cylinder body 60 and the combustion chamber 36 to allow the piston 66 to return to its start position more quickly, so that the tool 10 may be fired on a more rapid cycle than was possible with conventional tools.

To this end, the tool 10 is provided with a second fan 92 located between the cylinder head 34 and the air intake vents 32 to draw additional ambient air through the vents and cause it to flow along or through the combustion chamber 36, as well as along the outside of the cylinder body 60. In the preferred embodiment, the supplemental fan 92 is disposed in the tool 10 to rotate coaxially with the main fan 46. As such, the supplemental fan 92 is preferably mounted to an end 94 of the armature or power shaft 48 which is opposite the end 50 to which the main fan 46 is attached. However, it is contemplated that the supplemental fan 92 could also be powered by a separate motor 96 secured to the housing 12 at some other point, such as to the air vents 32 (shown in phantom in FIG. 2).

Regardless of where it is secured or how it is positioned, the ultimate goal of the supplemental fan 92 is the forcing of cooling air along the outside of the combustion chamber 36 and the cylinder body 60 yet within the main housing 12 as indicated by the arrows 84 and seen in FIG. 1 when the tool 10 is in the closed position. While conventional tools used the fan 42 as a source of cooling air, this fan was unable to provide cooling when the tool was in the closed position (FIG. 1).

Further, when the tool 10 is in the open position as shown in FIG. 2, the rotating supplemental fan 92 forces cooling air through the combustion chamber 36 and along the outside of the cylinder body 60 as shown by the arrows 90. In this manner, the supplemental fan 92 enhances scavenging of the spent fuel gas from the combustion chamber 36.

The air forced through the tool 10 by the supplemental fan 92 cools the walls of the combustion chamber from the outside when the tool is closed, and from the inside when the tool is open. The air flow represented by the arrows 84 and 90 which is generated in large part by the supplemental fan 92 also cools the outside of the walls of the lower portion of the cylinder body 60.

The main difference between the flow patterns in FIGS. 1 and 2 is caused by the engagement of the radial air dam 76 with the inner surface of the 78 of the main housing 12 as seen in FIG. 2. This engagement prevents air from flowing down along the outside of the reciprocating valve member 52 and instead, deflects the air into the combustion chamber 36. From the chamber 36, the forced cooling air flows along an inner surface 98 of the valve member 52 and passes along the outside of the cylinder body 60.

As a result of the provision of the supplemental fan 92, the combustion chamber 36, the valve member 52 and the cylinder body 60 are sufficiently cooled so that exhaust gas is more rapidly condensed. As such, a vacuum is more quickly created in the cylinder, which facilitates the return of the piston 66 to the upper end of the cylinder 60. Another advantage of the supplemental fan 92 is that by preventing the combustion chamber 36 and the cylinder 60 from becoming overheated, the overall durability of the tool is increased.

Figure 3:
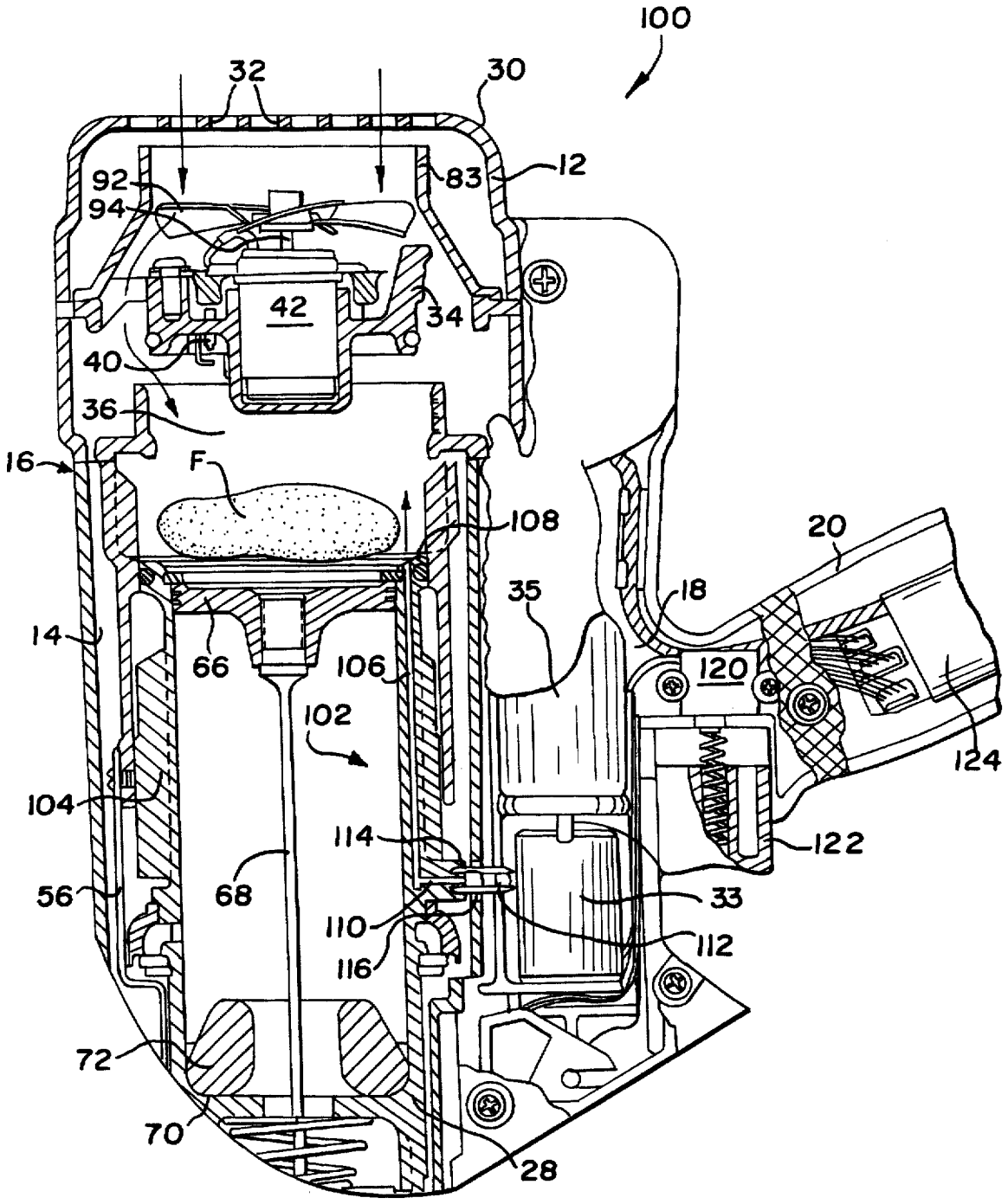
FIG. 3 is a fragmentary side view of an alternate embodiment of the combustion powered tool of the invention with portions shown cut away for clarity.

Referring now to FIG. 3, an alternate embodiment of the tool 10 is generally indicated as 100. Features of the tool 100 which correspond with those of the tool 10 have been designated with identical reference numerals. The main difference between the tools 10 and 100 is that the tool 100, which is depicted in the open position, has the main fan 46 eliminated and replaced with a fuel mixture injection apparatus or fuel injector indicated generally as 102.

The fuel injector 102 includes a modified cylinder body 104 provided with a fuel injection passageway 106 which runs substantially parallel with the longitudinal axis of the body 104, and is provided with an outlet port 108 opening into the combustion chamber 36 at a lower end thereof, and an angled inlet port 110. The inlet port 102 is preferably disposed at an approximate right angle to the main passageway 106 to properly engage a valve outlet nipple 112.

In the preferred embodiment, a resilient, rubber-like sleeve coupler 114 slidingly engages the outlet nipple 112, and also engages the inlet port 110. An opening 116 in the housing 12 provides access for the coupler 114. The resilient nature of the coupler 114 accommodates misalignment and vibration due to tool-generated shock (i.e., from combustion), and its insulative character keeps heat away from the valve 33. At the same time, the coupler 114 is configured to maintain a gas-tight seal between the passageway 106 and the valve 33. In this manner, the valve 33 places the fuel cell 35 in fluid communication with the passageway 106.

The relatively narrow diameter of the passageway 106, in combination with the high temperatures to which the fuel is exposed by passing through the cylinder wall, increases the velocity of the fuel and speeds its travel to the combustion chamber 36. In this manner, the fuel is injected into the combustion chamber in at least a partially vaporized state, which enhances air movement in the combustion chamber 36, mixes the fuel and air, and facilitates combustion. Since the tool 100 also is provided with the supplemental fan 92, the above-described advantages of cooling and scavenging will also be featured in the tool 100.

The fuel will circulate throughout the chamber and will reach the spark plug 40. An electrical discharge at the spark gap of the spark plug 40 is initiated by the user by actuating a trigger switch 120 through a trigger 122, which releases a signal from a central electrical distribution and control unit 124. The control unit 124, also provided to the tool 10, controls the operation of the fans 46 and 92 so that they continue to nm during the firing of the tool and for a predetermined amount of time thereafter, which preferably includes a time while the combustion chamber 36 is opened (FIG. 2).

As described above with reference to the drawings, features of the present invention provide for more rapid cooling of the combustion chamber post firing, and thus more rapid return of the piston to the combustion chamber. The ultimate result is the reduction of the cycle time between firings, and longer operational life for the tool.

While a particular embodiment of the combustion tool with dual fans of the invention has been shown and described, it will be appreciated by those skilled in the art that changes and modifications may be made thereto without departing from the invention in its broader aspects and as set forth in the following claims.

I claim:

1. A combustion powered tool having a self-contained internal combustion power source constructed and arranged for creating a combustion for driving a driver blade to impact a fastener and drive it into a workpiece, comprising:

a housing having a main chamber enclosing the power source;

a combustion chamber defined within said main chamber;

air flow enhancing means disposed in said combustion chamber for enhancing the flow of air therein; and a supplemental air flow enhancing means disposed externally of said combustion chamber and within said housing for forcing air past said combustion chamber as a cooling mechanism.

2. The tool as defined in claim 1, wherein said air flow enhancing means is a fan disposed for axial rotation within said combustion chamber.

3. The tool as defined in claim 1, wherein said air flow enhancing means is a fuel injector located in said combustion chamber.

4. The tool as defined in claim 1 wherein said supplemental air flow enhancing means is a fan.

5. The tool as defined in claim 4 wherein said air flow enhancing means is a fan powered by an electric motor having a power shaft, said air flow enhancing means is secured to a first end of said shaft, and said supplemental air flow enhancing fan is mounted on an opposite end of said shaft.

6. The tool as defined in claim 1 wherein said tool cycles during operation between a closed position and an open position, and wherein said supplemental air flow enhancing means is constructed and arranged to provide a flow of air when said combustion chamber is in the closed position.

7. The tool as defined in claim 1 wherein said supplemental air flow enhancing means is constructed and arranged to be operable independently from said air flow enhancing means.

8. The tool as defined in claim 7 wherein said supplemental air flow enhancing means is constructed and arranged to operate during firing of said tool and for a predetermined time after firing including after the combustion chamber is opened.

9. A combustion powered fastener driving tool having a self-contained internal combustion power source and constructed and arranged for creating a combustion for driving a driver blade to impact a fastener and drive it into a workpiece, comprising:

a housing having a main chamber enclosing the power source;

a combustion chamber being defined within said main chamber;

a cylinder body within said main chamber enclosing a piston to drive the driver blade toward the fastener as the piston is driven toward a terminal end of said cylinder; and a supplemental air flow enhancing means located externally of said combustion chamber and within said housing for drawing ambient air into said housing and past at least one of said combustion chamber and said cylinder body during operation.

10. The tool as defined in claim 9 wherein said supplemental air flow enhancing means is a fan being powered by an axial motor shaft, said motor shaft being coaxial with said main chamber.

11. The tool as defined in claim 9 further including a combustion chamber fan disposed in said combustion chamber.

12. The tool as defined in claim 11 wherein said combustion fan and said air flow enhancing fan are disposed at opposite ends of an electric motor power shaft.

13. The tool as defined in claim 9 further including means for mixing fuel and air for said combustion, said means for mixing being disposed in one of said combustion chamber, externally of said combustion chamber, and within said housing.

14. The tool as defined in claim 13 wherein said means for mixing disposed within said combustion chamber is a fan.

15. The tool as defined in claim 13 wherein said means for mixing disposed externally of said combustion chamber is a fuel injector.

16. A combustion powered fastener driving tool having a self-contained internal combustion power source and constructed and arranged for creating a combustion for driving a driver blade to impact a fastener and drive it into a workpiece, comprising:

a housing having a main chamber enclosing the power source;

a combustion chamber being defined within said main chamber;

a cylinder within said main chamber enclosing a piston to drive the driver blade toward the fastener as the piston is driven toward a terminal end of said cylinder;

an air flow enhancing means located externally of said combustion chamber and within said housing for drawing ambient air past at least one of said combustion chamber and said cylinder during operation; and mixing means for mixing air and fuel for combustion in said combustion chamber, said mixing means being one of a fan and a fuel injector.

17. The tool as defined in claim 16 wherein said air flow enhancing means is a first fan powered by a motor shaft, and said means for mixing is a second fan.

18. The tool as defined in claim 17 wherein said first and second fans are secured to opposite ends of the same motor shaft.

* * * * *